US007963427B2

(12) United States Patent
Calkin

(10) Patent No.: US 7,963,427 B2
(45) Date of Patent: Jun. 21, 2011

(54) STRAP ATTACHMENT SYSTEM

(75) Inventor: Carston R. Calkin, Tualatin, OR (US)

(73) Assignee: Skedco, Inc., Tualatin, OR (US)

( * ) Notice: Subject to any disclaimer, the term of this patent is extended or adjusted under 35 U.S.C. 154(b) by 793 days.

(21) Appl. No.: 11/652,174

(22) Filed: Jan. 10, 2007

(65) Prior Publication Data

US 2007/0158380 A1 Jul. 12, 2007

Related U.S. Application Data

(60) Provisional application No. 60/758,510, filed on Jan. 11, 2006.

(51) Int. Cl.
*A45C 15/00* (2006.01)
*A45F 3/14* (2006.01)
*A41D 1/04* (2006.01)

(52) U.S. Cl. ..... 224/675; 24/3.7

(58) Field of Classification Search ..... 224/675, 224/579, 578, 580, 583, 222, 250; 2/102, 2/338; 24/3.7
See application file for complete search history.

(56) References Cited

U.S. PATENT DOCUMENTS

| | | | | |
|---|---|---|---|---|
| 5,259,093 | A | 11/1993 | D'Annunzio | |
| 5,724,707 | A * | 3/1998 | Kirk et al. | 24/3.7 |
| 6,279,804 | B1 * | 8/2001 | Gregg | 224/675 |
| 7,047,570 | B2 * | 5/2006 | Johnson | 2/102 |
| 7,200,871 | B1 * | 4/2007 | Carlson | 2/103 |
| 7,240,404 | B2 * | 7/2007 | Flossner | 24/3.7 |
| 7,490,358 | B1 * | 2/2009 | Beck | 2/2.5 |
| 2006/0113344 | A1 | 6/2006 | Cragg | |
| 2008/0257922 | A1 | 10/2008 | Cragg | |

* cited by examiner

*Primary Examiner* — Justin M Larson
*Assistant Examiner* — Lester L Vanterpool
(74) *Attorney, Agent, or Firm* — Stoel Rives LLP

(57) ABSTRACT

A strap attachment apparatus is arranged to releasably secure pocket and pouch members, holsters, selected holders and other types of removable articles securely yet removably in quick-release manner onto supporting articles including packs and backpacks, luggage, bags, jackets, vests and other garments and types of support articles by releasably interwoven strap components which require no other metal, plastic or molded mechanical fasteners such as snaps, buttons, hooks, VELCRO connectors or other locking arrangement which may snag, catch or otherwise interfere with or hinder installation of and quick-release removal of the attached article.

15 Claims, 4 Drawing Sheets

STRAP ATTACHMENT SYSTEM

This application claims benefit under 35 U.S.C. 119(e) of the priority filing of U.S. Provisional application Ser. No. 60/758,510, filed 11 Jan. 2006.

BACKGROUND OF THE INVENTION

The present invention relates generally to strap type connector arrangements for releasably securing pocket members, pouches, holsters and other articles securely yet removably onto supporting articles such as backpacks, luggage, jackets, vests, garments and other supporting articles, and more particularly to such strap attachment arrangements that releasably secure a removable article to a supporting, second article only by the interweaving connection of individual, flexible strap member components secured to the first and second articles.

Strap type attachment apparatus has been provided heretofore and are well known fastening systems for releasably securing an article removably to a supporting article, such has been disclosed in U.S. Pat. No. 5,724,707 to Kirk, et al.; U.S. Pat. No. 5,259,093 to D'Annunzio; and U.S. Pat. No. 6,279,804 to Gregg which each teach different structural arrangements for accomplishing the purpose. The patent to Kirk, et al. is believed to be most closely related to the present invention. Strap-type attachment arrangements are preferred because they provide an extremely strong yet detachable securement of various pocket-type members onto garments and such worn or carried by persons, particularly military personnel and emergency and rescue personnel, as well as hunters and fishermen. Such removable articles provided in the form of pocket members or pouches are typically provided to hold handguns, ammunition clips, grenades, medical supplies, canteens and many other types of supplies and gear necessary to the personnel's functioning in the field. The strap type attachment arrangements permit removal and exchange of alternate sizes, types and arrangements of the pouch members as may be desired, and desired repositioning of the pocket members on the supporting article as best suits the purpose of the wearer at the time.

However, it is well known that these arrangements typically employ the use of mechanical fastening members such as buttons, snaps, hooks, VELCRO connectors, and other metal and molded plastic fixtures on the ends of strap members, which fixtures inherently tend to snag and otherwise hinder the weaving of the straps during installation of the pocket member on the supporting article, and snag and interfere with the quick removal of the articles when it is desired to quickly pull the pocket member off of the supporting article. In military and other emergency situations, this snagging and difficult removal of the pouches can present serious problems for the user, particularly when speed is imperative for the user's safety.

SUMMARY OF THE INVENTION

In its basic concept this invention provides a strap attachment apparatus arranged to provide a strong, secure but quick release strap connection of a removable article to a base support mount article without need of any mechanical fastener members such as snaps, buttons, VELCRO type members or other that may obstruct and interfere with the quick release and installation operation of the attachment apparatus by providing an equal number of laterally spaced-apart, longitudinally extending securement strap members on each of the articles to be secured together, the securement strap members on one of the articles being positioned for extension aligned with the spaces between the extending securement strap members on the other article, and the lateral end-most strap member on the one article positioned to substantially overlie the end-most strap member on the other article, for interweaving of at least one laterally extending connector strap member through aligned securement loops provided by the aligned securement strap members to secure the articles releasably together, the terminal end of the connector strap directed in the reverse direction into captured confinement within a securement loop of an endmost securement strap member whereby to effectively lock the connector strap against inadvertent reverse weaving during the rigors of operative securement of the articles to each other.

It is by virtue of the foregoing basic concept that the principal objective of the present invention is achieved; namely, the provision of a strap attachment apparatus of the class described which overcomes the limitations and disadvantages of strap attachment systems of the prior art.

Another object and advantage of this invention is the provision of a strap attachment apparatus of the class described which completely avoids the use of snaps, buttons, hooks, fasteners, VELCRO-type components, and other protruding devices for releasably securing the connected strap members in a locked condition against inadvertent disassembly and loss of the secured article.

Another object and advantage of this invention is the provision of a strap attachment apparatus of the class described which is arranged to facilitate smooth and quick connection of a removable article to a supporting article and provide for unhindered, quick-release disconnection and removal of an attached article from a fixed, base article when needed.

Another object and advantage of this invention is the provision of a strap attachment apparatus of the class described in which the attachment apparatus and its constituent components may be formed substantially entirely of selected fabric materials by stitching and sewing if so desired or needed, and thereby avoid additional necessary manufacturing steps, materials and processes.

Still another object and advantage of this invention is the provision of a strap attachment apparatus of the class described which provides a flexible yet strong interconnection of a removable article to a fixed, base article and which is effectively locked in secured, connected condition against inadvertent and undesirable disconnection.

A further object and advantage of this invention is the provision of a strap attachment apparatus of the class described that provides a secure mounting connection of an article against separation against the extreme rigors of wear in military and other rough conditions of use.

A still further object and advantage of this invention is the provision of a strap attachment apparatus of the class described that is of simplified construction for economical manufacture and reliability and durability in operation.

The foregoing and other objects and advantages of the present invention will appear from the following detailed description, taken in connection with the accompanying drawings of a preferred embodiment.

DESCRIPTION OF THE PREFERRED EMBODIMENT

Figure 1:
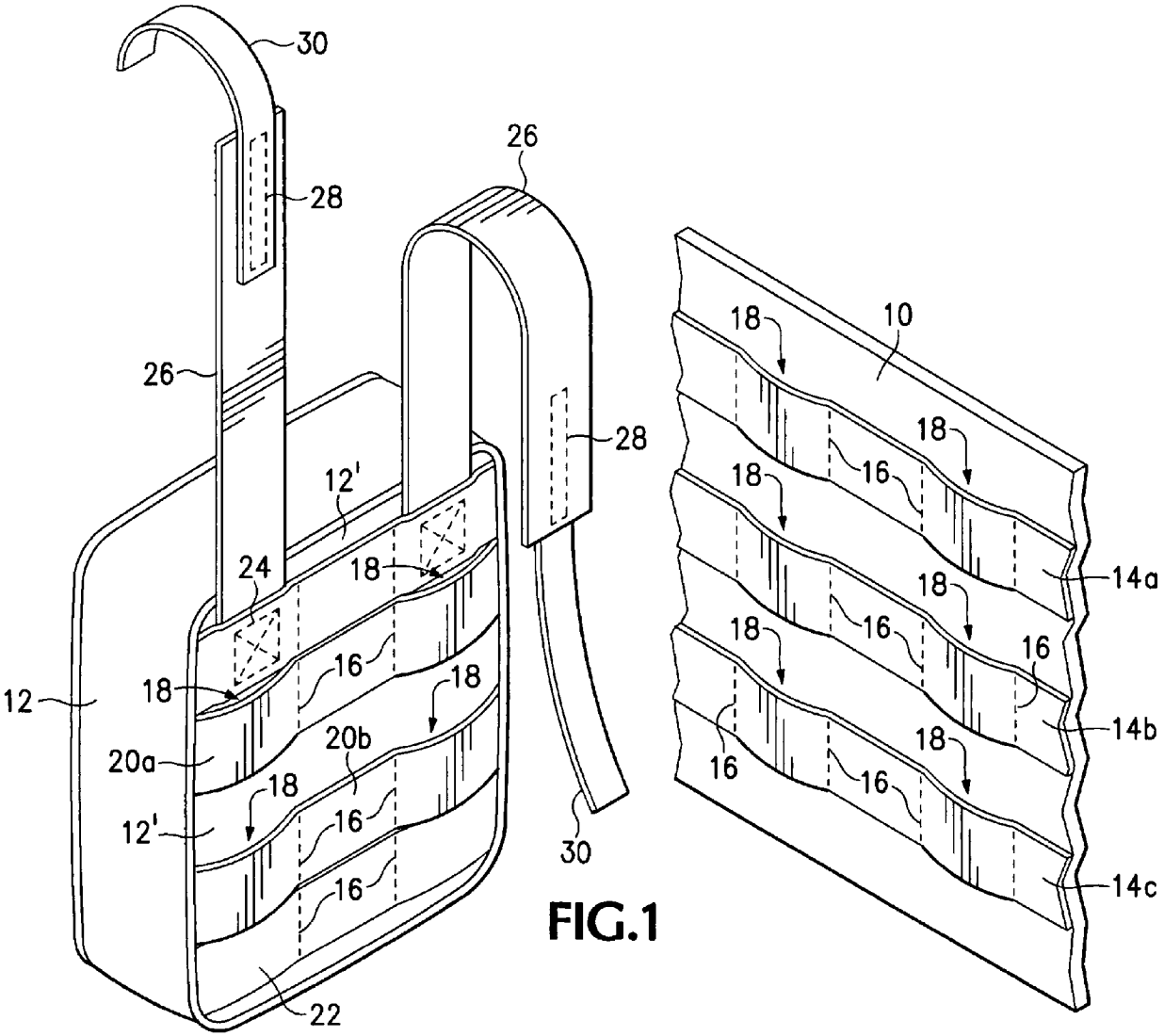
FIG. 1 is a fragmentary perspective view of a base panel of a supporting article and a removable pocket type article shown in a separated condition preliminary to connection of the respective components of the strap attachment apparatus for securing the articles together.

Referring to the particular embodiment of the invention shown in FIGS. 1-5 of the drawings, there is illustrated a portion of a base panel mounting surface 10 which may be the external panel surface of any supporting article such as a bag, a backpack, a jacket, vest or other garment, a piece of luggage, or other supporting article which is to releasably receive and securely mount a separate, removable, overlying article such as a pocket member or other removable article which is represented herein by the pouch member 12 illustrated. Typically, the base surface 10 is a panel portion area of flexible fabric material such as canvas, nylon or other material suitable for the purpose of the particular construction of the base article itself, as is readily recognized by those skilled in the art.

As shown, the base surface 10 mounts a plurality, at least two and three in this embodiment, longitudinally extending, longitudinally elongated securement straps 14*a*-14*c* secured in laterally spaced apart condition to the surface by suitable means such as by sewing or stitching 16 illustrated. As will be understood, these straps, or web members, are typically and preferably formed of flexible material such as nylon webbing material well known for its strength, durability and high resistance to wear and breaking. Other suitable fabric materials may of course alternatively be provided as may be desired or needed for the purpose. As seen clearly in the drawings, each of the longitudinally extending straps 14*a*-14*c* is secured to the underlying base in laterally spaced apart condition, the particular spacing therebetween being illustrated herein as being approximately equal to the width, or lateral dimension of the individual straps 14*a*-14*c* for reasons which will become apparent later.

For reasons which will also become clear, each securement strap member 14*a*-14*c* is arranged, when secured on the base surface 10 as by sewing or stitching 16, to provide at least one longitudinally spaced apart, laterally aligning row of open loops or securement loop channels 18 as seen clearly in the drawings.

With reference again to FIG. 1 of the drawings, and now in particular with the pouch or pocket member 12 to be secured in confronting condition against the face of the base surface 10, the rear, confronting side wall 12' of the pocket member 12 also mounts a plurality, a pair in this embodiment, of longitudinally elongated, longitudinally extending securement strap members 20*a*, 20*b* secured thereto as by stitching 16 in laterally spaced apart condition similar to the arrangement of strap members 14*a*-14*c* described previously. However, as is readily apparent in the drawings, the strap members 20*a* and 20*b* are secured on the pocket member 12 so that when the pocket member 12 is positioned for securement against the mounting surface face of the base member, the securement strap 20*a* is aligned with the space between the securement strap members 14*a* and 14*b* on the base mounting surface, and the securement strap member 20*b* on the pocket member is aligned with the space between securement strap members 14*b* and 14*c*, as is clearly shown in FIG. 5 of the drawings. These pocket mounted strap members also provide open loops or securement loop channels 18 in longitudinally and laterally spaced alignment with the securement loop channels 18 of the strap members 14*a*-14*c* when the pocket member 12 is positioned for securement on the base surface 10.

Figure 3:
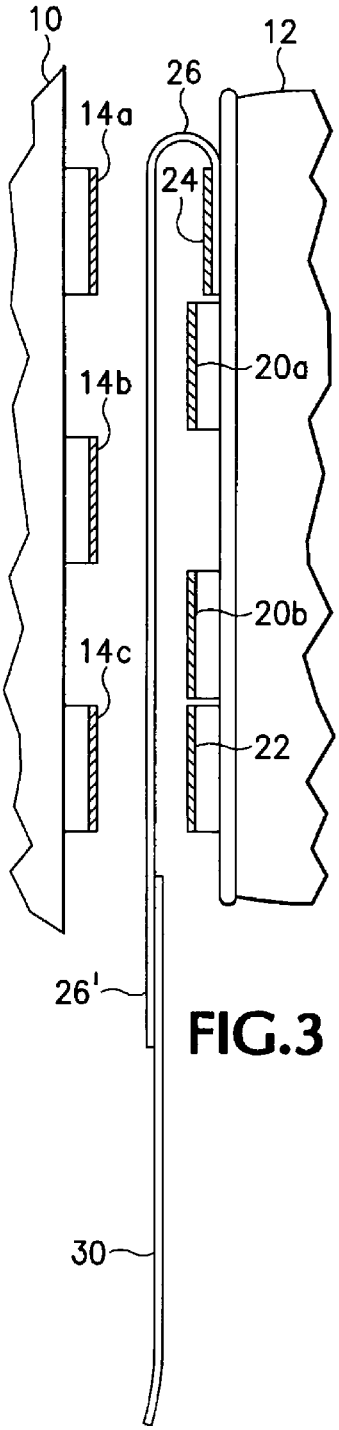
FIG. 3 is a fragmentary side elevational view of the supporting and removable articles in separated but aligned position for interweaving connection of the strap components.
Figure 5:
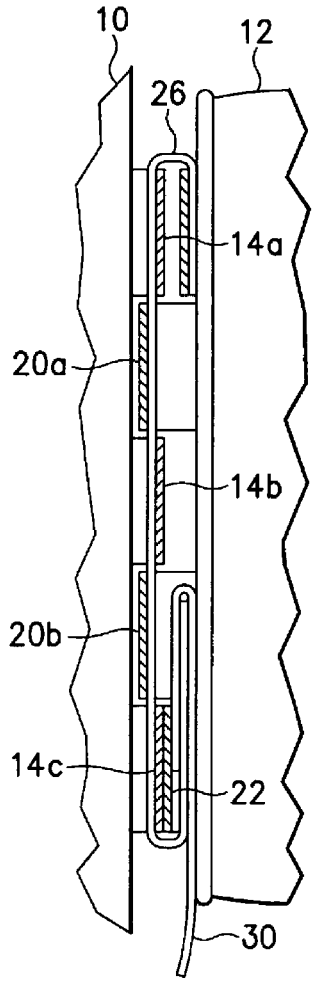
FIG. 5 is a fragmentary side elevational view of the pocket member attached to the mounting base support article, taken along the line 5-5 in FIG. 2, and showing the terminal end portion of the interwoven connector strap member tucked in reverse direction into the lateral end-most loop of the securement strap member in releasably locked condition of the apparatus.

As also clearly shown in the drawings, the strap attachment system of this invention also provides, in the particular embodiment illustrated, a third, lateral endmost, longitudinally extending securement strap member 22 secured on the pocket member 12 and positioned thereon in condition for overlying the lateral endmost strap member 14*c* secured on the base surface 10 when the pocket member 12 is positioned for attachment onto the base, as seen best in FIG. 5. This bottom endmost strap member 22 also forms, as by sewing or stitching 16, open loops or channels 18 arranged in longitudinally and laterally spaced alignment with the corresponding channels 18 of the previously described strap members 14*a*-14*c* and 20*a* and 20*b*. Accordingly it will be understood that there are an equal number of longitudinally extending securement strap members 20*a*, 20*b*, 22 on the pocket member as there are longitudinally extending securement strap members 14*a*-14*c* on the base, the laterally endmost spaced strap member 22 on the pocket arranged to confrontingly overlie the laterally endmost spaced securement strap 14*c* provided on the base such that a face of the third, lateral, endmost, longitudinally extending securement strap member 22 abuts a face of the lateral endmost strap member 14*c* along a horizontal contact surface, irrespective of whether the base mounts two, three, four or more longitudinally extending securement strap members. In a preferred embodiment, the distance between the endmost strap member 22 and strap member 20*b* is less than the distance between strap members 20*a* and 20*b*, as best seen in FIG. 3.

The rear side panel 12' of the pouch or pocket member 12 also mounts, as by rivets, stitching 24 or other suitable securing means, one, first, opposite longitudinal terminal end portion of at least one, and shown herein a pair of longitudinally spaced apart, laterally extending, elongated connector strap members 26. As is seen best in FIG. 1, the connector strap members 26 are secured to the pocket member in longitudinally spaced apart position disposed for alignment with the rows of aligned channels 18 formed by the longitudinally extending strap securement members 14*a*-14*c* and 20*a*, 20*b* and 22 previously described. As will become clear, the positioning of the laterally-elongated connector strap members 26 in alignment with the longitudinally spaced, laterally aligning channels 18 is required to permit weaving of the connector straps 26 through aligned channels 18 of the securement straps, as will be explained in detail.

As also shown clearly in the drawings, each laterally elongated connector strap member 26 may also mount, as by stitching 28, on its second, opposite free terminal end portion 26', an elongated flexible strip of material forming a flexible pull tab member 30 projecting from the terminal end of the connector strap. This flexible pull tab member 30 may also be formed as a strip of nylon webbing or other suitable flexible material selected for providing a flexible, elongated pull tab member on the end of each connector strap member for the intended purpose which will become clear.

Figure 2:
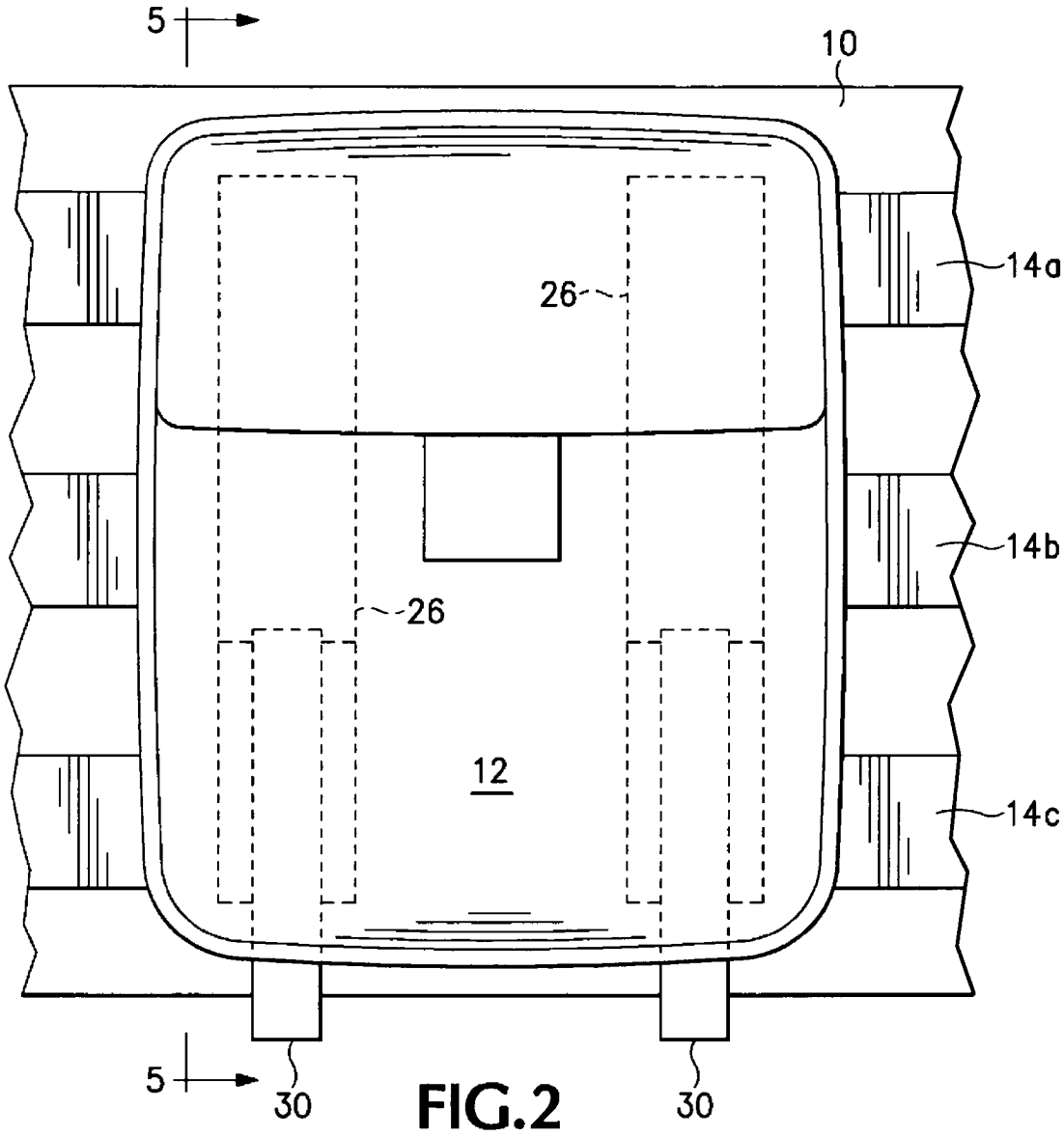
FIG. 2 is a fragmentary front elevational view showing the removable pocket article of FIG. 1 releasably secured to the supporting article by the connector strap components of this invention.

Having thus described the basic structural elements and arrangement of the various securement and connector strap members of the strap attachment apparatus of the present invention, reference will now be made primarily to FIGS. 2-5 of the drawings wherein the attachment of a pocket member 12 onto the mounting face surface 10 of a support member is shown. FIG. 2 illustrates a pocket member 12 in finish, secured condition on a supporting base 10. FIG. 5 is a view of the final tautly interwoven engagement of connector strap members 26 with securement strap members 14*a*-14*c* on the support base and 20*a*, 20*b* and 22 on the pocket member, as taken along the line 5-5 in FIG. 2. FIG. 3 is a view similar to FIG. 5 but showing the pocket member in position for connection to, but still separated from, the base 10 to highlight relative positioning of the base-mounted strap members 14*a*-14*c* and the pocket-mounted strap members 20*a*, 20*b* and 22.

As will be appreciated in viewing FIGS. 3 and 4, attachment of the pocket member 12 to the supporting base 10 is accomplished by effectively weaving the laterally-elongated connector strap members 26 through the respective, corresponding, laterally-aligned open channels 18 of the securement strap members 14*a*-14*c*, 20*a*-20*b* and 22 in alternating, laterally-descending fashion as will now be explained. First, a connector strap member 26 is selected and the free terminal end portion 26' is directed downwardly into, through and out of the opposite bottom opening of the corresponding open loop 18 of the top securement strap 14*a* attached to the base surface 10. The free end 26' is then directed into, through and out of the bottom opening of the corresponding, vertically-lower open loop 18 of the top securement strap 20*a* secured on the pocket member 12. The free end 26' of the connector strap member 26 is then directed in similar manner through the corresponding laterally aligned loops 18 of securement strap 14*b*, and then through the corresponding loop of strap 20*b* and then the open loop or channel of strap 14*c*, resulting in the condition shown in FIG. 4. The above interweaving process is then repeated with the other connector strap member 26 of the pair of lateral connector strap members shown in the instant embodiment of the invention.

Figure 4:
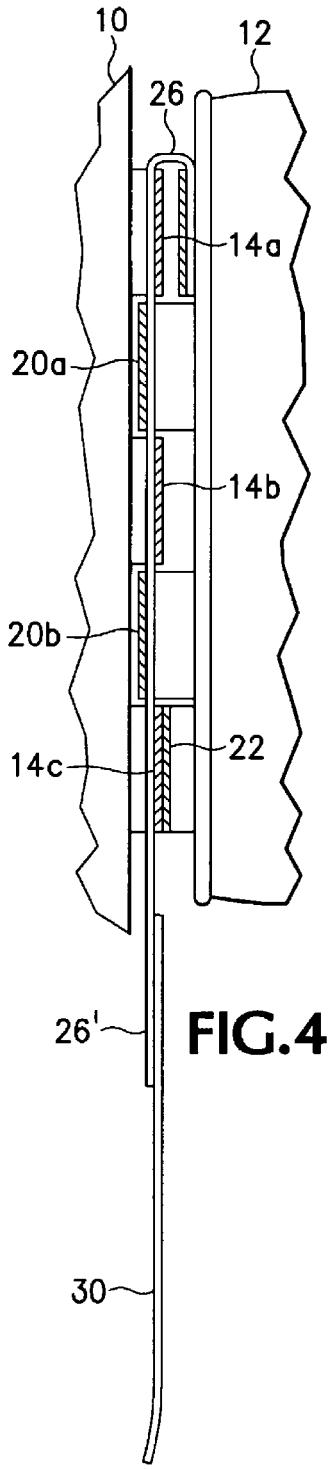
FIG. 4 is a fragmentary side elevational view subsequent interweaving of the connector strap components.

Attention is now directed to a comparison of the views of FIGS. 4 and 5 of the drawings. In this it is seen that the free terminal end portion 26' of each connector strap member 26 is finally trained, in the reverse direction, upwardly into the open bottom end of the open loop 18 formed by the endmost securement strap member 22 secured on the pocket member 12 in condition overlying the securement strap member 14*c* secured to the base article. The free terminal end 26' is then tucked fully upwardly thereinto with the pull tab member 30 extending in the reverse direction in order that its free terminal end extends rearwardly out of the bottom of the open loop or channel, as shown clearly in the finish condition of FIG. 5. In this condition, the connector strap members 26 are securely locked in their interwoven inter-engagement with the securement straps of the pocket member 12 and mounting base 10. This completely prevents any possibility of unintended detachment of the pocket member from its strap-mounted securement on the base member that may result from any reverse-weaving of the connector straps due to pulling or other separating forces applied against the mounted pocket member 12 when mounted on the base.

However, if it is desired that the pocket member 12 be released from its securement on the base, the operator need only pull downwardly on the pull tab member 30 on each connector strap member 26, thereby pulling the free terminal end 26' of each connector strap downwardly from its tucked-in, locked condition of FIG. 5 within the corresponding channel, and into the condition shown in FIG. 4, whereupon the pocket member may be pulled upon as needed to pull the connector strap members in the reverse direction through the loops of the securement strap members for separation and removal of the pocket member.

As will be appreciated by those skilled in the art, the free terminal end portions 26' of each connector strap 26 may include a stiffener member (not shown) such as a strip of plastic material or other stiffening arrangement as may be desired to stiffen the end portions 26' in order to further reduce the possibility of unintended downward movement of the captured end portion when in its tucked in, captured engagement within the channel 18 of the strap member 22 when in the locked condition shown in FIG. 5. Also it will be apparent to those skilled in the art that the present strap type attachment apparatus completely avoids snaps, loops, buckles, VELCRO fastener members, and other projecting locking members which heretofore have been recognized to snag and otherwise interfere with passage of the free ends 26' of the connector strap members 26 through the respective securement loops or channels both in the weaving, installation direction and particularly in the reverse, separation direction. This arrangement thus provides for facilitated and quicker attachment and detachment of the pocket members onto their supporting bases as will be apparent.

Figure 6:
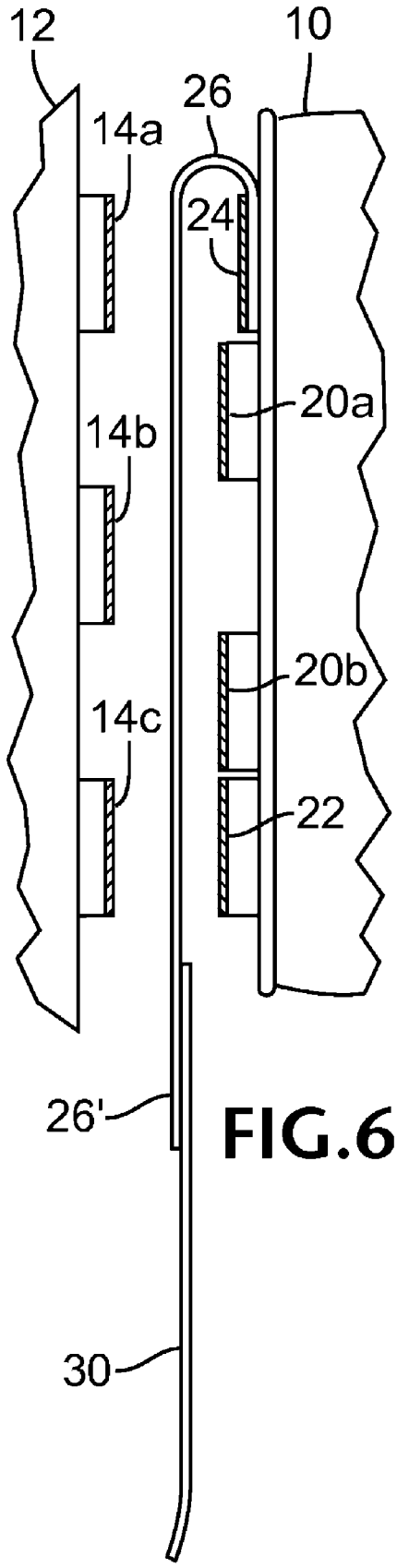
FIG. 6 is a fragmentary side elevational view of an embodiment of a supporting and a removable article in separated but aligned position for interweaving connection of the strap components.

FIG. 6 illustrates an alternate embodiment where connector strap members 26 are connected to a supporting article, such as supporting base 10, for attaching a removable article, such as pocket member 12, to the supporting article. For example, connector strap members 26 may be woven through open channels 18 of the securement strap members 14*a*, 14*b*, 14*c*, 20*a*, 20*b*, and 22 as described above.

Those skilled in the art will also appreciate that although the invention has been shown and described herein as utilizing a pair of longitudinally spaced apart, laterally-elongated connector strap members 26, pocket members may alternatively utilize one, two or even more connector straps as needed or desired, as usually may be determined by the size and type of pocket member or other article being secured onto the base mount article. Also, as previously mentioned, although the illustrated embodiment utilizes three longitudinally extending securement strap members provided on both the base and pocket members, there may alternatively be provided as few as two securement strap members or a plurality of more than the three shown, as may be desired or needed for the purpose. In any case, the number of securement straps provided on base and pocket respectively are always equal, with the endmost strap on the removable article being arranged to overlie the bottommost strap member on the base mount article.

From the foregoing it will be apparent to those skilled in the art that many various changes, other than those already discussed hereinbefore, may be made in the size, shape, type, number and arrangement of parts described hereinbefore without departing from the spirit of this invention and the scope of the appended claims.

Having thus described my invention and the manner in which it may be used, I claim:

1. A strap attachment apparatus for securing a removable article releasably to a supporting article, the strap attachment apparatus comprising:

a) a first plurality of longitudinally extending, laterally spaced apart securement strap members secured on a supporting article, the first plurality of securement strap members including an endmost securement strap member, said first plurality of securement strap members providing at least one laterally aligned row of securement loop channels, b) a second plurality of longitudinally extending, laterally spaced apart securement strap members secured on a removable article to be releasably attached to the supporting article, said second plurality comprising a number of securement straps sized and laterally spaced to fit between the securement straps secured on the supporting article and including an endmost securement strap member positioned on the removable article to overlie the endmost securement strap member on the supporting article such that a face of the endmost securement strap member positioned on the removable article abuts a face of the endmost securement strap on the supporting article along a horizontal contact surface when said supporting article and said removable article are secured together and at least one elongated, laterally extending connector strap member secured at one terminal end to the removable article is tautly interwoven through the first plurality of longitudinally extending, laterally spaced apart securement strap members and the second plurality of longitudinally extending, laterally spaced apart securement strap members, except for the endmost securement strap member positioned on the removable article, c) said second plurality of securement strap members provide at least one laterally aligned row of securement loop channels for receiving the at least one elongated, laterally extending connector strap member, and d) wherein the at least one elongated, laterally extending connector strap member extends in one direction from a securement loop channel of the endmost securement strap member on the supporting article and subsequently extends in the opposite direction into the securement loop channel of the endmost securement strap member on the removable article for releasably captured, locking engagement of the terminal end of the connector strap within the confines of said securement loop channel when said support article and said removable article are secured together.

2. The strap attachment apparatus of claim 1 wherein said securement strap members on the supporting article and removable article form a plurality of longitudinally spaced apart, laterally aligned rows of securement loop channels, and a plurality of longitudinally spaced apart connector strap members are secured on one of the articles in alignment with said aligned rows of securement loop channels for interweaving extension of the connector strap members with a corresponding aligned row of securement loop channels.

3. The strap attachment apparatus of claim 1 including an elongated, flexible pull tab member secured on the at least one connector strap member and configured for extension out of the endmost securement loop member when said opposite terminal end of the connector strap member is releasably captured within the confines of the securement loop member.

4. The strap attachment apparatus of claim 1 wherein said securement strap members and connector strap members are formed of a selected, flexible fabric material secured on the removable and supporting articles by sewing or stitching.

5. The strap attachment apparatus of claim 4 wherein said selected, flexible fabric material comprises a selected webbing material.

6. A strap attachment apparatus for releasably securing a removable article to a supporting article, the strap attachment apparatus comprising:

a first plurality of longitudinally extending, substantially evenly laterally spaced apart straps secured on a supporting article, including a first endmost strap;

a first laterally aligned row of loops, the first row including a loop in each of the first longitudinally extending, laterally spaced apart straps;

a second plurality of longitudinally extending, substantially evenly laterally spaced apart straps secured on a removable article and sized and laterally spaced to fit between the straps of the first plurality of longitudinally extending, substantially evenly laterally spaced apart straps;

a second endmost strap on the removable article positioned adjacent the second plurality of straps to substantially overlie the first endmost strap on the supporting article when said supporting article and said removable article are secured together, wherein a distance between the second endmost strap and a closest one of the second plurality of longitudinally extending, substantially evenly laterally spaced apart straps is less than a distance between each of the second plurality of longitudinally extending, substantially evenly laterally spaced apart straps;

a second laterally aligned row of loops, the second row including a loop in each of the second longitudinally extending, laterally spaced apart straps;

a loop in the second endmost strap; and an elongated, laterally extending connector strap secured to the removable article, the connector strap interwoven through the first and second rows of loops in the first and second plurality of straps to emerge from the loop in either the first endmost strap or the second endmost strap and doubled back in an opposite direction and tucked into the loop in the other of the first endmost strap or the second endmost strap when said supporting article and said removable article are secured together.

7. The strap attachment apparatus of claim 6 further comprising a plurality of loops in the second endmost strap; and wherein said first and second pluralities of longitudinally extending, substantially evenly laterally spaced apart straps on the supporting article and removable article form a plurality of longitudinally spaced apart, laterally aligned rows of loop channels, and a plurality of longitudinally spaced apart connector straps are secured on the removable article in alignment with said laterally aligned rows of loop channels for interweaving extension of the connector straps with a corresponding aligned row of loop channels.

8. The strap attachment apparatus of claim 6 including an elongated, flexible pull tab secured on each connector strap and configured for extension out of the loop in the first or second endmost strap when a free end of each connector strap is releasably captured within the confines of one of the loops in the first or second endmost strap.

9. The strap attachment apparatus of claim 6 wherein said first and second pluralities of longitudinally extending, substantially evenly laterally spaced apart straps and the connector strap are formed of a selected, flexible fabric material secured on the removable and supporting articles by sewing or stitching.

10. The strap attachment apparatus of claim 9 wherein the selected, flexible fabric material includes a selected webbing material.

11. A strap attachment apparatus for releasably securing a removable article to a supporting article, the strap attachment apparatus comprising:

a first plurality of longitudinally extending, substantially evenly laterally spaced apart straps secured on a removable article, including a first endmost strap;

a first laterally aligned row of loops, the first row including a loop in each of the first longitudinally extending, laterally spaced apart straps;

a second plurality of longitudinally extending, substantially evenly laterally spaced apart straps secured on a supporting article and sized and laterally spaced to fit between the straps of the first plurality of longitudinally extending, substantially evenly laterally spaced apart straps;

a second endmost strap on the supporting article positioned adjacent the second plurality of straps to substantially overlie the first endmost strap on the removable article when said supporting article and said removable article are secured together, wherein a distance between the second endmost strap and a closest one of the second plurality of longitudinally extending, substantially evenly laterally spaced apart straps is less than a distance between each of the second plurality of longitudinally extending, substantially evenly laterally spaced apart straps;

a second laterally aligned row of loops, the second row including a loop in each of the second longitudinally extending, laterally spaced apart straps;

a loop in the second endmost strap; and an elongated, laterally extending connector strap secured to the supporting article, the connector strap interwoven through the first and second rows of loops in the first and second plurality of straps to emerge from the loop in either the first endmost strap or the second endmost strap and doubled back in an opposite direction and tucked into the loop in the other of the first endmost strap or the second endmost strap when said supporting article and said removable article are secured together.

12. The strap attachment apparatus of claim 11 further comprising a plurality of loops in the second endmost strap; and wherein said first and second pluralities of longitudinally extending, substantially evenly laterally spaced apart straps on the removable article and supporting article form a plurality of longitudinally spaced apart, laterally aligned rows of loop channels, and a plurality of longitudinally spaced apart connector straps are secured on the supporting article in alignment with said laterally aligned rows of loop channels for interweaving extension of the connector straps with a corresponding aligned row of loop channels.

13. The strap attachment apparatus of claim 11 including an elongated, flexible pull tab secured on each connector strap and configured for extension out of the loop in the first or second endmost strap when a free end of each connector strap is releasably captured within the confines of one of the loops in the first or second endmost strap.

14. The strap attachment apparatus of claim 11 wherein said first and second pluralities of longitudinally extending, substantially evenly laterally spaced apart straps and the connector strap are formed of a selected, flexible fabric material secured on the removable and supporting articles by sewing or stitching.

15. The strap attachment apparatus of claim 14 wherein the selected, flexible fabric material includes a selected webbing material.

* * * * *